United States Patent [19]

Weber

[11] 4,403,819

[45] Sep. 13, 1983

[54] EDGE BOARD LOCK

[75] Inventor: Robert N. Weber, Hummelstown, Pa.

[73] Assignee: AMP Incorporated, Harrisburg, Pa.

[21] Appl. No.: 323,210

[22] Filed: Nov. 20, 1981

[51] Int. Cl.[3] ..... H01R 13/62

[52] U.S. Cl. ..... 339/75 MP; 339/176 MP

[58] Field of Search ..... 339/74 R, 75 M, 75 MP, 339/176 MP

[56] References Cited

U.S. PATENT DOCUMENTS

| | | | |
|---|---|---|---|
| 3,899,234 | 8/1975 | Yeager et al. | 339/74 R |
| 3,963,317 | 6/1976 | Eigenbrode et al. | 339/74 R |
| 4,047,782 | 9/1977 | Yeager | 339/75 MP |
| 4,165,909 | 8/1979 | Yeager et al. | 339/75 MP |
| 4,189,200 | 2/1980 | Yeager et al. | 339/75 MP |

*Primary Examiner*—John McQuade

*Assistant Examiner*—Gary F. Paumen

*Attorney, Agent, or Firm*—Russell J. Egan

[57] ABSTRACT

A locking device is disclosed for use with an open ended, rotary cam actuated, zero insertion force edge board connector to block the card receiving slot of the connector thereby preventing any damage to contacts mounted therein by movement of a circuit board laterally with respect to the connector when the contacts are closed and, therefore, improperly positioned for such movement. The locking device also ensures proper operation of the ZIF connector by preventing closure of the terminals onto an improperly positioned circuit board. The two piece construction of the subject locking device makes it easier to manufacture and far less prone to breakage than previously known similar devices.

4 Claims, 3 Drawing Figures

EDGE BOARD LOCK

The present invention relates to a locking device for use with an open ended, rotary cam actuated, zero insertion force edge board connector to block the card receiving slot thereby preventing any damage to contacts mounted therein by movement of a circuit board laterally with respect to the connector when the contacts are closed and, therefore, improperly positioned for such movement.

There are many well known zero insertion force (ZIF) connectors that are cam actuated and are used for engaging edge portions of circuit boards. An example may be found in U.S. Pat. No. 3,899,234, the disclosure of which is incorporated herein by reference. Initially, these edge board connectors received the associated circuit board only in a straight plug in configuration. However, as design criteria changed, the dimensions available for circuit board insertion were reduced, and it soon became apparent that there would not always be room for a straight plug in configuration. It was also decided at that time that perhaps the circuit boards ought to be making electrical interconnection at least on two opposite ends or edges resulting in the zero insertion force connectors being arranged in spaced opposing pairs and the circuit boards being slipped in edgewise from the ends of the connectors. This created a number of new problems in that significant damage could be done to the terminals if they were in an engaged position when a board was to be slipped into place. Further, there was a problem of ensuring that the board had been properly fully inserted into the connector before activating the terminals into an engaged position. If the board was offset because of not being fully inserted, there would be the clear possibility of sending wrong signals, currents, or voltages to various portions of the circuit board which could so substantial damage to the components carried thereby. Thus, there is the need for a board locking device which will assure prevention of insertion of a circuit board when the connector is not conditioned to receive such a circuit board, and which will assure closing of the terminals only when a circuit board is properly positioned in the connector.

One proposed solution to the above discussed problem is found in U.S. Pat. No. 4,165,909, the disclosure of which is incorporated herein by reference. This patent teaches a unitary lock member which is mounted on the rotary cam and is moved thereby between positions blocking and providing access to the connector recess for edgewise insertion of a circuit board. However, the disclosed lock member has proved to be difficult to mold and to lack sufficient strength to withstand rough handling.

The present invention concerns a board lock to be used in combination with a known zone insertion force edge board connector of the type having an elongated housing defining a board receiving slot, a plurality of terminals arranged along at least one side of the slot, and a rotary cam extending the length of the bottom of the slot, and a cam follower actuated by the cam to drive the terminals between engaged and disengaged positions characterized by a board lock and board lock hub mounted on one end of the rotary cam to be driven thereby between positions opening and closing access to an end of the slot, the board lock and hub act as a clutch system which is actuated by the cam rod. As the cam rod is rotated, the inner board lock is allowed to slip until the last portion of travel by the cam rod when the outside hub hits the board lock and opens with continued rotation of the cam rod. On reverse rotation on the cam rod, the board lock is again allowed to slip until the last few degrees of travel when the outside hub engages and returns the board lock to the locking position.

An embodiment of the present invention will now be described by way of example with reference to the accompanying drawings in which.

Figure 1:
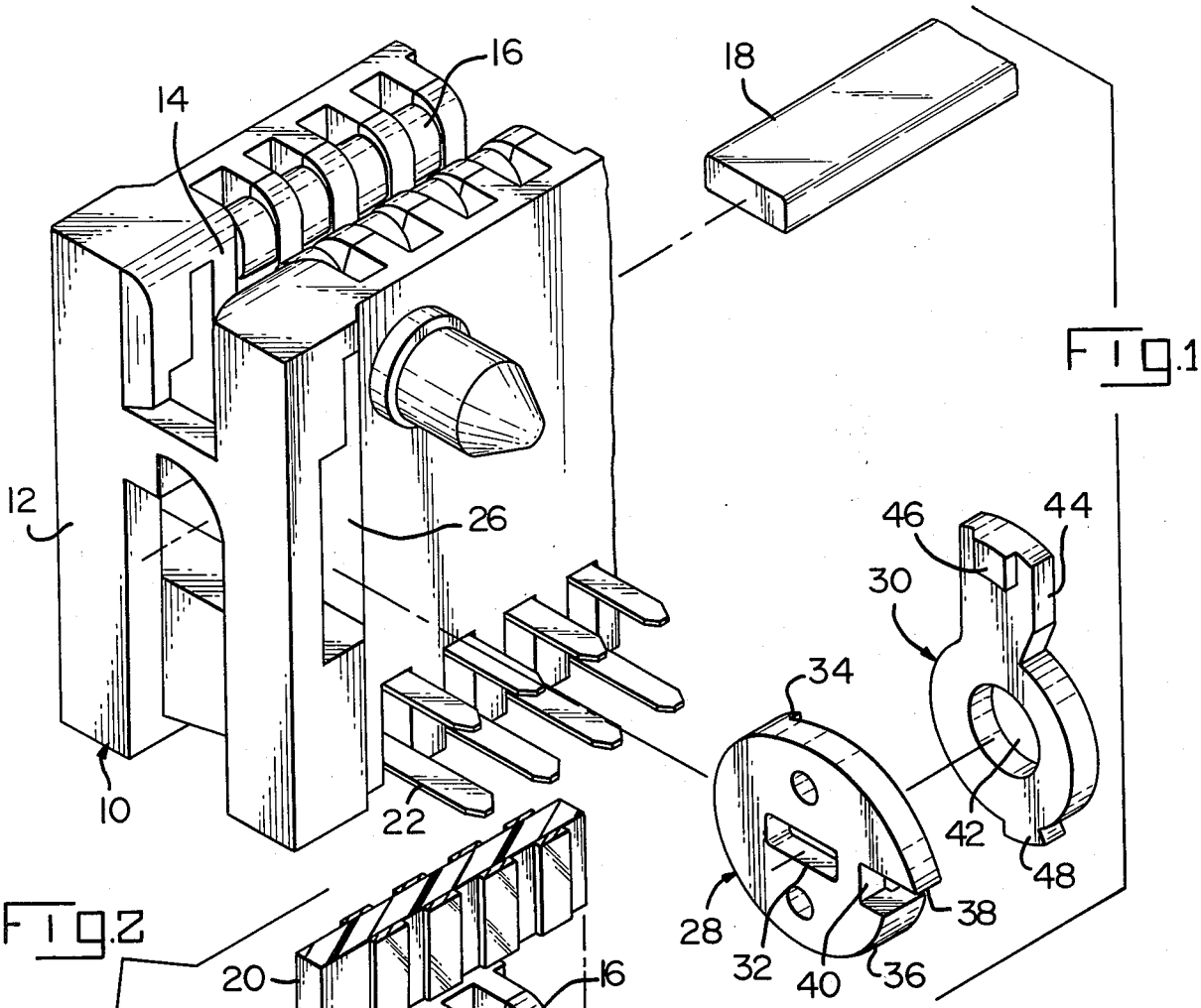
FIG. 1 is an exploded perspective view of the components of the present invention together with an end portion of a ZIF connector.

Only an end portion of a rotary ZIF connector 10 have been shown. The details of this connector can be found by reference to the above mentioned Pat. No. 3,899,234, the disclosure of which is incorporated herein by reference. The connector includes an elongated housing 12 of rigid insulative material defining an elongated edge board receiving groove 14 having a plurality of electrical terminals 16 mounted therein in along at least one side of the slot with the terminals held in fixed spaced relation. An elongated cam member 18 is arranged to lie extending through the connector at the bottom of the groove 14 to drive a cam follower (not shown) so as to open and close the terminals 16 for engagement with a daughter board 20. The terminals 16 also have mounting tails 22 for engagement with appropriate portions of a mother board (not shown).

The present invention includes a profiled slot or groove 26 extending transversely through the housing 12 and at least partially intersecting the groove 14 and providing access to the cam member 18. The board lock 24 is mounted in the slot 24 and includes a hub member 28 and a board lock member 30. The hub member 28 includes a profiled central aperture 32 adopted to closely receive the cam member 18 therein to be rotatably driven therewith. The hub member 28 also includes first and second radially spaced and axially extending lugs 34, 36, radial lug 38, and profiled groove 40 adjacent the lug 38. The board lock member 30 includes a circular axial aperture 42, a locking arm 44, with a lug 46, and a hub engaging lug 48.

Figure 3:
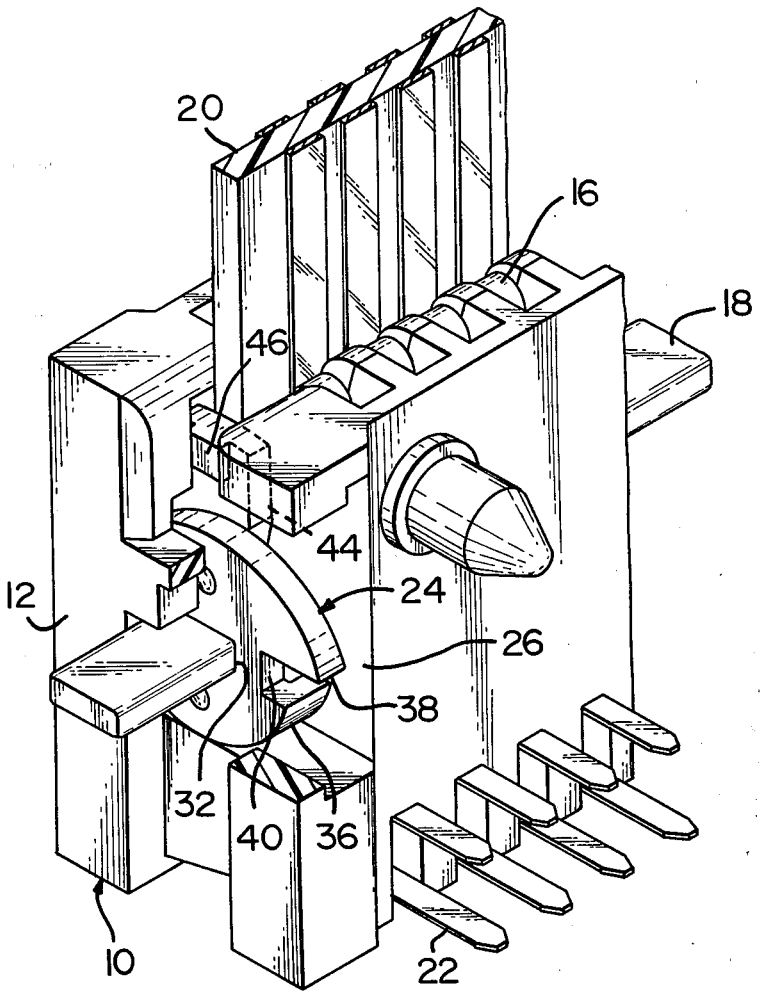
FIG. 3 is a perpective view, similar to FIG. 2, showing the subject invention in the locked or closed condition.

The subject locking assembly is inserted into the slot 26 and the cam 18 is run through the apertures 42 and 32 to secure the assembly therein. It will be noted that in the closed position of the terminals, that is with the cam member 18 lying in a horizontal position as shown in FIGS. 1 and 3, that the locking arm 44 will lie in the end of the groove 14 preventing a circuit board 20 from being inserted into or withdrawn from the connector in an edgewise fashion.

Figure 2:
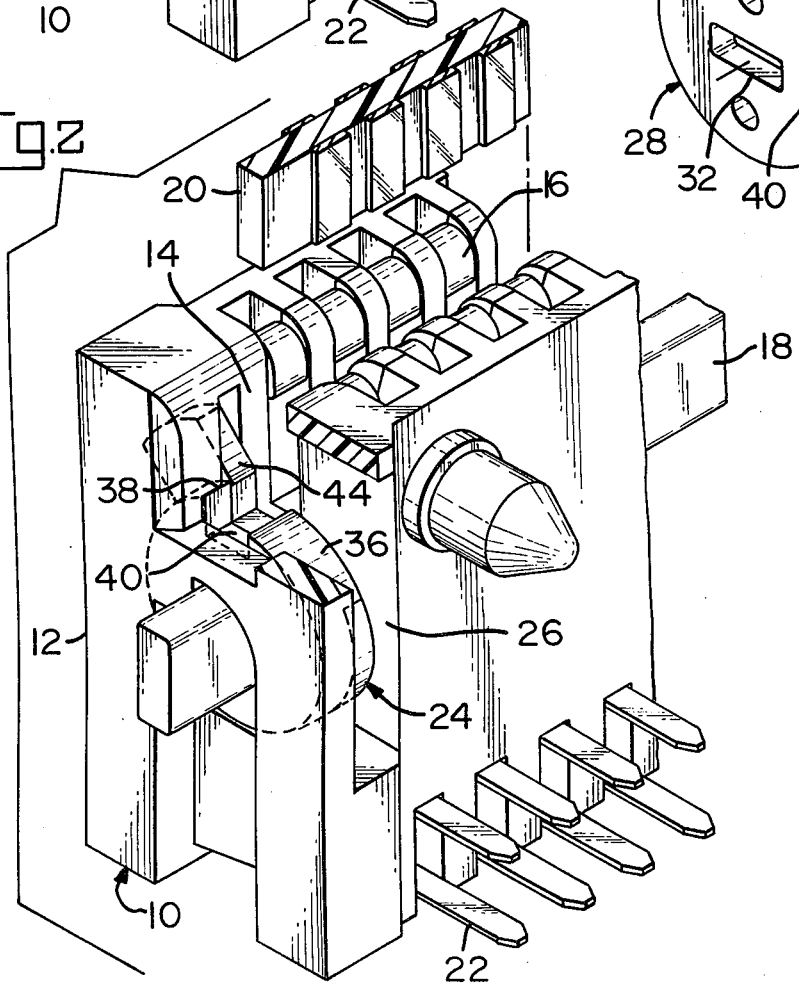
FIG. 2 is a perspective view of an end of the ZIF connector, partially in section, showing the subject invention in the unlocked or open condition.

Rotary movement of the cam member 18 in a counterclockwise direction, as shown in the drawings, will drive the hub member 28 in a counterclockwise direction bringing the lug 34 into eventual contact with the lug 48 to drive the locking arm 44 into the recess 26 freeing the groove 14 as shown in FIG. 2. In this position the groove 40 of hub member 28 is aligned with the groove 14 of the connector housing 12. The lug 46 makes a friction engagement in slot 26 to hold the lock 30 in the open condition. The reverse rotary movement of the cam 18 will first drive lug 38 of hub 28 into groove 14. If the circuit board 20 has not been fully inserted, lug 38 will strike the circuit board and prevent further rotation of the cam 18 and closure of the terminals. If the circuit board 20 has been properly fully inserted, there will be a delay as hub member 28 rotates before lug 36 comes into engagement with the lug 48 of lock 30 to return the locking arm 44 to the position shown in FIG. 3.

I claim:

1. In combination with a zero insertion force edge board connector having an elongated housing defining an elongated circuit board receiving groove, a plurality of terminals mounted in fixed spaced relationship along at least one side of said groove, an elongated rotary cam member extending along the bottom of said groove and a cam follower mounted in said groove adapted to be driven by said cam member so as to drive said terminals between engaged and disengaged positions, a board lock preventing access to and egress from at least one end of said groove, said board lock comprising:

a hub member having an axial aperture profiled to receive said cam member therein in driving engagement, and first and second radially spaced lugs extending axially from one side surface of said hub member, and a locking member having a central aperture profiled for free rotation on said cam member therein, a first radially directed arm of sufficient length to block said groove of said connector housing and an oppositely directed lug, whereby rotary movement of said cam drives said hub member until one of said radially spaced lugs engages the lug of the locking member to drive it between a first position with said ram arm blocking an end of said housing groove and a second position with said arm free of said housing groove.

2. The combination according to claim 1 wherein said hub member further comprises:

a radial lug, whereby, said radial lug is the first to engage a misaligned circuit board to prevent further rotation of said cam member and closure of said terminals.

3. The combination according to claim 1 wherein said hub member further comprises:

a groove which, in said second position, is aligned to form an extension of said connector groove.

4. A board lock adapted to be mounted on a rotary cam member of an end loadable, rotary cam actuated, zero insertion force edge board connector, preventing access to an egress from said connector in an end direction, said board lock comprising:

a hub member having an axial profiled aperture receiving at least a portion of a cam member of said connector therein in driving relation, and first and second radially spaced axially directed lugs extending from one side surface of said hub member, and a locking member having a central aperture profiled for free rotation on said cam member therein, a first radially directed arm of sufficient length to block a groove of said connector and an oppositely directed lug, whereby rotary movement of said cam drives said hub member until a radially spaced lug engages the lug of said locking member to drive it between a first position with said arm blocking an end of said connector groove and a second position with said arm free of said connector groove.

* * * * *